US009711839B2

(12) United States Patent
Morton et al.

(10) Patent No.: US 9,711,839 B2
(45) Date of Patent: Jul. 18, 2017

(54) FREQUENCY SELECTIVE LIMITER

(71) Applicant: Raytheon Company, Waltham, MA (US)

(72) Inventors: Matthew A. Morton, Reading, MA (US); Gerhard Sollner, Winchester, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/996,881

(22) Filed: Jan. 15, 2016

(65) Prior Publication Data

US 2016/0181679 A1 Jun. 23, 2016

Related U.S. Application Data

(63) Continuation-in-part of application No. 14/077,909, filed on Nov. 12, 2013, now Pat. No. 9,300,028.

(51) Int. Cl.

| | |
|---|---|
| ***H01P 9/00*** | (2006.01) |
| ***H01P 1/22*** | (2006.01) |
| ***H01P 1/203*** | (2006.01) |
| *H01P 9/02* | (2006.01) |
| *H01P 1/365* | (2006.01) |

(52) U.S. Cl.

CPC ..... *H01P 9/00* (2013.01); *H01P 1/2039* (2013.01); *H01P 1/227* (2013.01); *H01P 1/365* (2013.01); *H01P 9/02* (2013.01)

(58) Field of Classification Search

CPC ..... H01P 1/203; H01P 1/2039; H01P 1/227; H01P 9/02; H01P 9/00; H01P 1/218

USPC ..... 333/17.2, 116, 157, 158, 161, 162, 163

See application file for complete search history.

(56) References Cited

U.S. PATENT DOCUMENTS

| | | | |
|---|---|---|---|
| 4,605,911 | A | 8/1986 | Jin |
| 4,980,657 | A | 12/1990 | Stitzer et al. |
| 5,023,573 | A | 6/1991 | Adam |

(Continued)

OTHER PUBLICATIONS

Adam, J. Douglas; "Frequency Selective Limiters for High Dynamic Range Microwave Receivers;" IEEE Transactions on Microwave Theory and Techniques, vol. 41, No. 12; Dec. 1, 1993; pp. 2227-2231 (5 pages).

(Continued)

*Primary Examiner* — Benny Lee
*Assistant Examiner* — Jorge Salazar, Jr.
(74) *Attorney, Agent, or Firm* — Daly, Crowley, Mofford & Durkee, LLP

(57) ABSTRACT

The present disclosure is directed towards a frequency selective limiter having a first magnetic material disposed over a first dielectric material and a strip conductor disposed over the magnetic material. In some embodiments, the frequency selective limiter includes a second magnetic material disposed over the strip conductor and a second dielectric material disposed over the second magnetic material. The first and second dielectric material may have a lower relative permittivity than the first and second magnetic material. In an embodiment, the frequency selective limiter includes a slow wave structure disposed to magnetically couple a magnetic field, produced by electromagnetic energy propagating through the slow wave structure, into the magnetic material.

13 Claims, 12 Drawing Sheets

(56) References Cited

U.S. PATENT DOCUMENTS

| | | | | |
|---|---|---|---|---|
| 5,847,628 | A * | 12/1998 | Uchikoba | H01P 1/20 333/204 |
| 6,593,833 | B2 * | 7/2003 | Joines | H01P 1/181 333/238 |
| 7,656,167 | B1 | 2/2010 | McLean | |
| 2005/0093737 | A1 | 5/2005 | Schoebel | |
| 2007/0236400 | A1 * | 10/2007 | Rentz | H01Q 9/42 343/753 |
| 2011/0043299 | A1 | 2/2011 | Ding et al. | |
| 2015/0130564 | A1 | 5/2015 | Morton et al. | |

OTHER PUBLICATIONS

Chua et al.; "Microfabricated Planar Helical Slow-Wave Structures Based on Straight-Edge Connections for THz Vacuum Electron Devices;" Terahertz Science and Technology, ISSN 1941-7411, vol. 4, No. 4; Dec. 1, 2011; pp. 208-229 (22 pages).

S. Seki, et al.; "Cross-Tie Slow-Wave Coplanar Waveguide on Semi-Insulating GaAs Substrates;" Electronic Letters, vol. 17, No. 25; Dec. 10, 1981; pp. 940-941 (2 pages).

Steven N. Stitzer et al.; "A Multi-Octave Frequency Selective Limiter;" IEEE MTT-S Digest; May 31, 1983-Jun. 3, 1983; pp. 326-328 (3 pages).

Stitzer, S.N. et al.; "X-Band YIG Limiters for FM/CW Radar;" Microwave Journal, vol. 20; Dec. 1, 1977; pp. 35-38 (1 page). Abstract Only.

Suhl; "The Nonlinear Behavior of Ferrites at High Microwave Signal Levels;" Proceedings of the IRE, vol. 44, Issue 10; Oct. 1, 1956; pp. 1270-1284 (15 pages).

Office Action dated Jul. 22, 2015; for U.S. Appl. No. 14/077,909; 10 pages.

Response dated Oct. 8, 2015 to Office Action dated Jul. 22, 2015; for U.S. Appl. No. 14/077,909; 11 pages.

Second Response dated Oct. 14, 2015 to Office Action dated Jul. 22, 2015; for U.S. Appl. No. 14/077,909; 11 pages.

Notice of Allowance dated Dec. 8, 2015; for U.S. Appl. No. 14/077,909; 10 pages.

Tsutsumi, et al.; "Magnetostatic-Wave Envelope Soliton in Microstrip Line Using YIG-Film Substrate"; IEEE Transactions on Microwave Theory and Techniques, vol. 48, No. 2; Feb. 1, 2000; 6 Pages.

Warit, et al.; "Microwave Circulator Using Yttrium Iron Garnet Film"; Microwave Conference, 2000 Asia-Pacific, Dec. 3, 2000; 2 Pages.

PCT Search Report and Written Opinion of the ISA for PCT/US2017/012937 dated Mar. 31, 2017; 18 Pages.

* cited by examiner

FREQUENCY SELECTIVE LIMITER

CROSS-REFERENCE TO RELATED APPLICATION

This application is a Continuation in Part of U.S. patent application Ser. No. 14/077,909, filed on Nov. 12, 2013, now U.S. Pat. No. 9,300,028 B2 issued on Mar. 29, 2016 which is incorporated herein by reference in its entirety, for any and all purposes.

GOVERNMENT INTERESTS

This invention was made with the government support under Contract No. N00173-14-C-2020 awarded by the U.S. Navy. The government has certain rights in this invention.

TECHNICAL FIELD

This disclosure relates generally to frequency selective limiter.

BACKGROUND

As is known in the art, a Frequency Selective Limiter (FSL) is a nonlinear passive device that attenuates signals above a predetermined threshold power level while passing signals below the threshold power level. A key feature of the FSL is the frequency selective nature of the high-power limiting: low power signals close in frequency to the limited signals are unaffected. In this sense, the FSL acts as a high-Q (>1000 demonstrated) notch filter that automatically tunes to attenuate high power signals within a narrow frequency band as illustrated in FIGS. 1A, 1B and 1C which illustrate the frequency selectivity of a typical YIG FSL; the frequency response of: an input to the FSL being illustrate in FIG. 1A, the transmission loss through the FSL being illustrated in FIG. 1B, it being noted that there is significant attenuation to the frequency components in the input signals having power levels above the predetermined power threshold level, $P_{TH}$ (FIG. 1A) while the frequency components in the input signals having power levels below the predetermined power threshold level, $P_{TH}$ pass through the FSL unattenuated (except for by the small signal losses (resistive losses, impedance mismatch, etc.) and output power spectra being illustrated in FIG. 1C, for multiple weak and strong signals. With FSL, the power threshold level is set primarily by the structure of a ferrite material. For example, single-crystal YIG material is a ferrite material that provides a lower power threshold than polycrystalline YIG, which is then lower than hexaferrite materials. The difference in power threshold between these materials is on the order of 10-20 dB, with single-crystal YIG providing the lowest of around 0 to +10 dBm. As is also known in the art, ferrite FSLs rely on the non-linear response of a magnetized ferrite material. Above a critical RF magnetic field level the spin precession angle saturates in the ferrite and coupling to higher order spin-waves starts to occur. RF energy fed to the FSL is coupled efficiently to spin-waves at approximately one-half the signal frequency and then converted to heat.

The threshold power levels for the onset of limiting range from <−30 dBm for magnetostatic wave FSLs to >40 dBm for polycrystalline ferrite in subsidiary resonance FSLs. The critical RF magnetic field is directly proportional to the spin-wave linewidth of the ferrite material. Liquid Phase Epitaxy (LPE) Yttrium-Iron-Garnet (YIG) is typically used because it has the narrowest spin-wave linewidth of all measured materials, on the order of 0.2-0.5 Oersted (Oe). This single crystal YIG approach provides the lowest insertion loss for weak signals, the highest-Q filtering response, and provides a power threshold on the order of 0 dBm—collectively making the material the most attractive for a wide variety of applications. A typical implementation of an FSL includes a strip conductor disposed between a pair of ground plane conductors in a stripline microwave transmission structure using two YIG slabs or films for the dielectric, as shown in FIG. 2, to couple the magnetic energy of the interfering signal into the magnetic material. Permanent biasing magnets are mounted to the sides, as shown, or may be mounted to the top and bottom of the structure. The strength of the magnetic field within the structure establishes the operating bandwidth of the limiter. An electro-magnet may be used in which case a wire, not shown, is wrapped around the entire structure to provide windings in a direction perpendicular to the stripline. DC current flows through the windings to provide a bias magnetic field. The bias is selected to establish the operating bandwith of the limiter. The slab thickness is generally 100 um or less because of the difficulty in growing thick YIG films, requiring stripline widths on the order of 20 um to achieve an input impedance $Z_0$ matched closely to 50 ohms. This approach is simple to fabricate and provides adequate magnetic fields to realize a critical power level of approximately 0 dBm when using single crystal YIG material. One method of reducing the power level threshold of the FSL is to use a lower input impedance stripline (i.e., less than 50 ohms); however, at the cost of degraded return loss. Thus, when using a lower input impedance structure, an impedance matching structure is sometimes used to improve the impedance match; however, this technique reduces the bandwidth and increases the insertion loss of the FSL; the approach reduces the resistive losses associated with the transmission structure for weak signals, and slightly increases the magnetic coupling of the signals with the ferrite material.

SUMMARY

The present disclosure is directed to a frequency selective limiter having a combination of magnetic material and dielectric material. The dielectric material has a lower relative permittivity or relative dielectric constant, ∈r, than the magnetic material, which results in an enhanced microwave transmission line. In an embodiment, this design improves an overall frequency selective limiter (FSL) performance by increasing the local magnetic interaction of the signal with the magnetic material, thereby achieving a lower threshold for the onset of the desired nonlinear behavior. The FSL may be implemented in any strip conductor configuration including but not limited to a microstrip configuration, a stripline configuration or a co-planar configuration.

With a lower power threshold, the present disclosure also enables the use of lower-cost materials (e.g. polycrystalline instead of single-crystal YIG), with significantly reduced complexity associated with manufacturing. Further, the insertion loss remains low with the proposed structure and the FSL performance parameters can be tuned via design changes in the transmission line structure rather than modifying material properties of the dielectric material. By using a pair of low dielectric substrates in addition to the pair of magnetic substrates, a slow wave FSL structure can be fabricated using common manufacturing techniques without requiring micromachining or etching of the magnetic materials, thereby resulting in a low cost solution.

In one aspect, the present disclosure is directed towards a slow wave structure having a combination of a dielectric material disposed about a magnetic material to magnetically couple a magnetic field, produced by electromagnetic energy propagating through the slow wave structure, into the magnetic material. The slow wave structure has an input impedance $Z_0$ and the impedances may periodically change from an impedance greater than $Z_0$ to an impedance less than $Z_0$ as the electromagnetic energy propagates through the slow wave structure.

In another aspect, the present disclosure is directed towards a combination of a magnetic material, a dielectric material disposed about the magnetic material and a slow wave structure disposed to magnetically couple a magnetic field, produced by electromagnetic energy propagating through the slow wave structure, into the ferromagnetic material. In an embodiment, the slow wave structure is a transmission line having an input impedance, $Z_0$. The transmission line includes a first transmission line section disposed between a pair of second transmission line sections. In an embodiment, the first transmission line section has an impedance $Z_H$ higher than $Z_0$ and the pair of second transmission line sections have an impedance lower than $Z_0$. In some embodiments, the first transmission line section and the pair of second transmission line sections each have a length shorter than a nominal operating wavelength of the electromagnetic energy propagating through the slow wave structure.

In another aspect, the present disclosure is directed towards a combination including a magnetic material, a dielectric material disposed about the magnetic material and a slow wave structure disposed to magnetically couple a magnetic field, produced by electromagnetic energy propagating through the slow wave structure, into the ferromagnetic material. In an embodiment, the slow wave structure is a transmission line having a first transmission line section disposed between a pair of second transmission line sections. The first transmission line section and the pair of second transmission lines sections include a strip conductor and at least one ground plane conductor. The magnetic material may be disposed between the strip conductor and the at least one ground plane conductor.

In some embodiments, the strip conductor includes a first strip conductor section disposed between a pair of second strip conductor sections. The first strip conductor section may be separated from a portion of the ground plane conductor disposed over the first strip conductor section a first distance D1. In some embodiments, the pair of second strip conductor sections are separated from portions of the ground plane conductor disposed over the pair of second strip conductor sections a second distance D2, where D1 and D2 are different distances.

In another aspect, the present disclosure is directed towards a combination including a magnetic material, a dielectric material disposed about the magnetic material and a slow wave structure disposed to magnetically couple a magnetic field, produced by electromagnetic energy propagating through the slow wave structure, into the ferromagnetic material. In some embodiments, the slow wave structure is a transmission line having a first transmission line section disposed between a pair of second transmission line sections.

In an embodiment, the first transmission line section and the pair of second transmission lines sections include a strip conductor and a pair of ground plane conductors. The strip conductor includes a first strip conductor section and a pair of second strip conductor sections with the first strip conductor section disposed between the pair of second strip conductor sections. In some embodiments, the first strip conductor section is separated from a portion of the pair of ground plane conductors disposed over and under the first strip conductor section a first distance D1. The pair of second strip conductor sections may be separated from portions of the ground plane conductor disposed over and under the pair of second strip conductor sections a second distance D2, where D1 and D2 are different distances.

In another aspect, the present disclosure is directed towards a frequency selective limiter. The frequency selective limiter includes a first layer of a dielectric material having first and second opposing surfaces and a first layer of magnetic material having first and second opposing surfaces. In an embodiment, the second surface of the first layer of the dielectric materials is disposed over the first surface of the first magnetic material and the dielectric material has a lower relative permittivity than the magnetic material. A strip conductor is disposed over the first layer of magnetic material.

In some embodiments, the frequency selective limiter includes a second layer of the dielectric material having first and second opposing surfaces and a second layer of magnetic material having first and second opposing surfaces. The first surface of the second layer of the dielectric materials is disposed over the second surface of the second magnetic material and the strip conductor is disposed between the first and second layer of magnetic material.

In an embodiment, the combination of the first and second layers of dielectric material and the first and second layers of magnetic material include a slow wave structure having an input impedance $Z_0$. The impedances may periodically change from an impedance greater than $Z_0$ to an impedance less than $Z_0$ as an electromagnetic energy propagates through the slow wave structure.

In some embodiments, the frequency selective limiter includes a first and second ground plane. The first ground plane is disposed over the first surface of the first layer of dielectric material and the second ground plane is disposed over the second surface of the second layer of dielectric material. The frequency selective limiter may include a first set of conducting pads disposed between the first layer of the dielectric materials and the magnetic material and a second set of conducting pads disposed between the second layer of the dielectric materials and the second magnetic material.

In an embodiment, a first set of vias is disposed within the first layer of dielectric material and a second set of vias is disposed within the second layer of dielectric material. The first set of vias couple the first ground plane to the first set of conducting pads and the second set of vias couple the second ground plane to the second set of conducting pads to form alternating sections of low impedance stripline sections and high impedance stripline sections within the slow wave structure. The alternating sections of low impedance stripline sections and high impedance stripline sections couple magnetic energy propagating through the slow wave structure and into that the first and second magnetic layers. The magnetic energy may have a power level above a predetermined power threshold.

In some embodiments, the frequency selective limiter is a transmission line having an input impedance, $Z_0$. The transmission line includes a first transmission line section disposed between a pair of second transmission line sections. The first transmission line section may have an impedance $Z_H$ higher than $Z_0$ and the pair of second transmission line sections have an impedance $Z_L$ lower than $Z_0$. In an embodiment, the first transmission line section and the pair of second transmission lines sections each have a length shorter than a nominal operating wavelength of electromagnetic energy propagating through the slow wave structure.

In another aspect, the present disclosure is directed towards a frequency selective limiter. The frequency selective limiter includes a magnetic material to magnetically couple a magnetic field, produced by electromagnetic energy propagating through the slow wave structure, into the magnetic material and a dielectric layer disposed over the magnetic material. In an embodiment, the dielectric layer has a lower relative permittivity than the magnetic material. The slow wave structure may have an input impedance $Z_0$ and the impedances may periodically change from an impedance greater than $Z_0$ to an impedance less than $Z_0$ as the electromagnetic energy propagates through the slow wave structure.

In some embodiments, a ground plane is disposed over a first surface of the dielectric layer. A set of conducting pads may be disposed between the dielectric layer and the magnetic material. Further, a set of vias may be disposed within the dielectric layer. In an embodiment, the set of vias couple the ground plane to the set of conducting pads to form alternating sections of low impedance striplines and high impedance striplines within the slow wave structure. In some embodiments, the alternating sections of low impedance striplines and high impedance striplines couple the electromagnetic energy propagating through the slow wave structure and into the magnetic material.

In another aspect, the present disclosure is directed towards a frequency selective limiter including a first and second layer of a dielectric material, each having first and second opposing surfaces. The frequency selective limiter further includes a first and second layer of magnetic material, each having first and second opposing surfaces. The second surface of the first layer of the dielectric materials is disposed over the first surface of the first magnetic material and the first surface of the second layer of the dielectric materials is disposed over the second surface of the second magnetic material. In an embodiment, the dielectric material has a lower relative permittivity than the magnetic material. A strip conductor may be disposed between the first and second layer of magnetic material.

In an embodiment, the slow wave structure is a transmission line having an input impedance, $Z_0$ and the transmission line includes a first transmission line section and a pair of second transmission line sections, and the first transmission line section has an impedance $Z_H$ higher than $Z_0$ and the pair of second transmission line sections have an impedance lower than $Z_0$. In some embodiments, the impedances periodically change from an impedance greater than $Z_0$ to an impedance less than $Z_0$ as an electromagnetic energy propagates through the slow wave structure.

In an embodiment, the frequency selective limiter includes a first and second ground plane. The first ground plane is disposed over the first surface of the first layer of dielectric material and the second ground plane is disposed over the second surface of the second layer of dielectric material. A first set of conducting pads may be disposed between the first layer of the dielectric materials and the magnetic material and a second set of conducting pads disposed between the second layer of the dielectric materials and the second magnetic material.

In an embodiment, a first set of vias is disposed within the first layer of dielectric material and a second set of vias is disposed within the second layer of dielectric material. The first set of vias couple the first ground plane to the first set of conducting pads and the second set of vias couple the second ground plane to the second set of conducting pads to form alternating sections of low impedance striplines and high impedance striplines within the slow wave structure. In an embodiment, the first transmission line section and the pair of second transmission lines sections each have a length shorter than a nominal operating wavelength of electromagnetic energy propagating through the slow wave structure.

The inventors have recognized that while slow wave structures (SWS) have been used to produce larger time delays for the same physical length, they exploit the property of the SWS in producing locally-strong magnetic fields. The structure creates locally-strong magnetic coupling, thereby decreasing the effective power threshold via electrical design rather than modification to the material properties. Further, using periodic segments of very low characteristic impedances, the inventors increase the magnetic interaction of the microwave signals with the magnetic, e.g., YIG substrate, thereby reducing the effective power threshold of when nonlinearity occur and thereby achieves a lower threshold for the onset of the desired nonlinear behavior. This enables the use of lower-cost polycrystalline YIG material with similar threshold and loss performance to single-crystal YIG substrates, or when used with single-crystal material enables lower threshold power for improved compatibility with sensitive receiver architectures. Additionally, the ability to design for localized strengths of magnetic field enable engineering of the FSL transfer characteristics of its limiting region of operation without changes to the material itself. Further, when high and low impedance segments of equal length are used and the product of their native characteristic impedances is equal to $Z_0^2$ and a 50Ω characteristic impedance is maintained for the composite transmission line.

In one embodiment, the strip conductor includes a first strip conductor section disposed between a pair of second strip conductor sections, and wherein the first strip conductor section is separated from a portion of the pair of ground plane conductors disposed over and under the first strip conductor section a first distance D1, and wherein the pair of second strip conductor sections are separated from portions of the ground plane conductor disposed over and under the pair of second strip conductor sections a second distance D2, where D1 and D2 are different distances. In this embodiment, the strip conductor width has been set to a constant that minimizes small-signal insertion loss, and the impedance is set by varying the vertical distance of the ground planes using conductive vias. While the limiter is matched to 50.0Ω, the numerous low-impedance sections of the slow wave structure couple significantly higher magnetic energy into the magnetic material, locally reducing the power threshold. This reduces the total effective power threshold, without also degrading the return loss or instantaneous bandwidth of the device. The strip conductor width is been set to a constant that minimizes small-signal insertion loss, and the impedance is set by varying the vertical distance of the ground planes using conductive vias. While the complete FSL component is matched to 50Ω, the numerous low-impedance sections of the slow wave structure couple significantly higher magnetic energy into the material, locally reducing the power threshold. This reduces the total effective power threshold, without also degrading the return loss or instantaneous bandwidth of the device.

It is noted that with a slow wave structure, repeating pair of high and low impedance segments is used where each segment is much less than a wavelength (λ, where λ, is the nominal operating wavelength of the slow wave structure) (in practice, <(λ)/10, but the smaller the better). Because the segments are electrically small, the effective impedance of the entire transmission line structure is the square root of the product of the two impedances. This is why it is desired the product be $Zo^2$. For example, a structure could have 100 ohm and 25 ohm impedance segments; however, 10 ohms and 250 ohms, or even 5 ohms and 500 ohms, may be preferred. The difficulty here is achieving the >100 ohm line; however, with this last embodiment using the vertical vias for the low impedance sections makes this easier to achieve as the ground plane is moved away from the strip conductor sections to achieve the high impedance rather than making the center conductor extremely small.

Further, the FSL performance parameters can be tuned via design changes in the transmission line structure rather than optimize material properties of the dielectric. Here, the power threshold is now a function of both the material properties and of the transmission line structure. Because the slow wave structure features stronger magnetic coupling into the magnetic material, the effective threshold of power is lower because less RF power is needed to achieve the same magnetic field strength. An additional benefit is the ability to design for a specific threshold power. It is much easier to design a slow wave structure to provide a specific magnetic field strength (hence threshold power level, $P_{TH}$) than it is to tune the material properties of the magnetic material.

Further, while the helical slow wave structure has been used as a slow wave structure in TWTAs (traveling wave tube amplifiers) to slow the RF signal down such that the speed is the same as electrons that are traveling down the length of the tube through the center of the helical so that the electrons generated from an electron gun terminate on the other side of the tube and that because the electrons and RF signals are traveling at the same speed, they interact and the intensity of the RF signal is increased as it propagates down the coil; the inventors have recognized the helical structure can be used intensify the magnetic coupling of the RF signal with a magnetic material at the center or core of the helical to now, instead of interacting with the electron beam, interacts with the magnetic material and that this interaction will causes spinwaves which dissipate heat in the crystal structure of the magnetic material at half the frequency of the RF signal to attenuate the signal. These spinwaves dissipate the energy as heat.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

FIG. 1A showing the frequency spectrum of an input signal to the FSL; FIG. 1B showing the transmission loss through the FSL, it being noted that there is significant attenuation to the frequency components in the input signals having power levels above the predetermined power threshold level, $P_{TH}$ (FIG. 1A) while the frequency components in the input signals having power levels below the predetermined power threshold level, $P_{TH}$ pass through the FSL unattenuated (except for by the small signal losses (resistive losses, impedance mismatch, etc.); and FIG. 1C showing the output power spectra of the FSL for multiple weak and strong signals;

FIG. 5A being a cross sectional view of a FSL having a helical slow wave structure formed on a magnetic substrate, the substrate having a helical coil conductor disposed around it, the substrate being bonded to a dielectric slab, the dielectric slab having a metal trace to provide a ground conductor for the FSL structure; FIG. 5B being a plan view of a top of the magnetic substrate; FIG. 5C being a plan view of a bottom plan of the magnetic substrate; FIG. 5D being a plan view of bottom of the lower dielectric slab; and FIG. 5E being a diagrammatical isometric of the FSL having the helical slow wave structure of FIGS. 5A-5D; and wherein the cross section of FIG. 5A is taken along line 5A-5A n FIG. 5D, the top view of FIG. 5B being designated by the line 5B-5B in FIG. 5A, the bottom view of FIG. 5C being indicated by the line 5C-5C in FIG. 5A, and the bottom view of FIG. 5D being indicated by the line 5D-5D in FIG. 5A;

Like reference symbols in the various drawings indicate like elements.

DETAILED DESCRIPTION

Figure 1A:
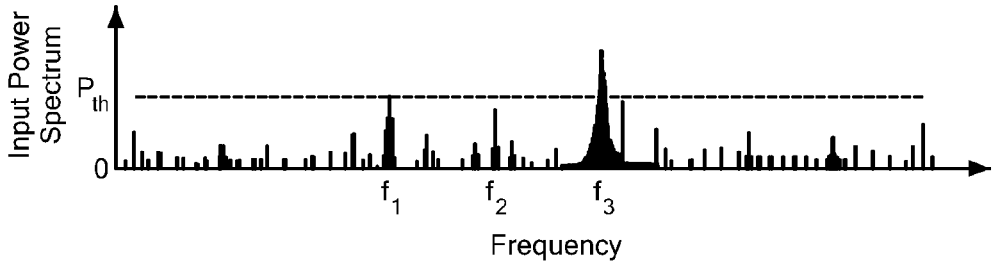
FIG. 1A PRIOR ART
FIGS. 1A, 1B and 1C illustrate the frequency response of an Frequency Selective Limiter (FSL) according to the PRIOR ART.
Figure 1B:
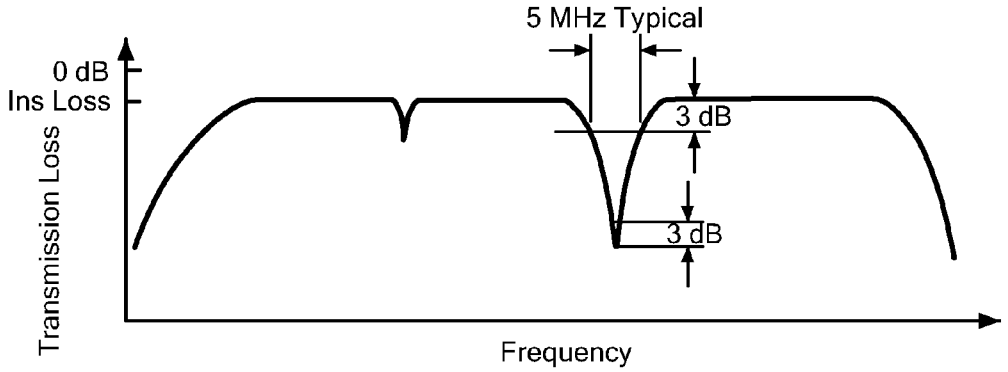
FIG. 1B PRIOR ART
Figure 1C:
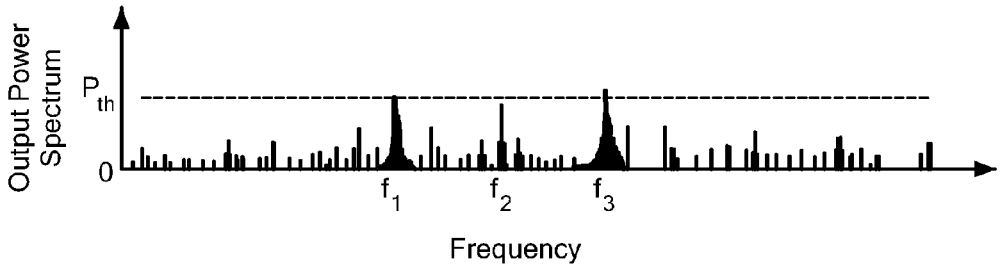
FIG. 1C PRIOR ART
Figure 2:
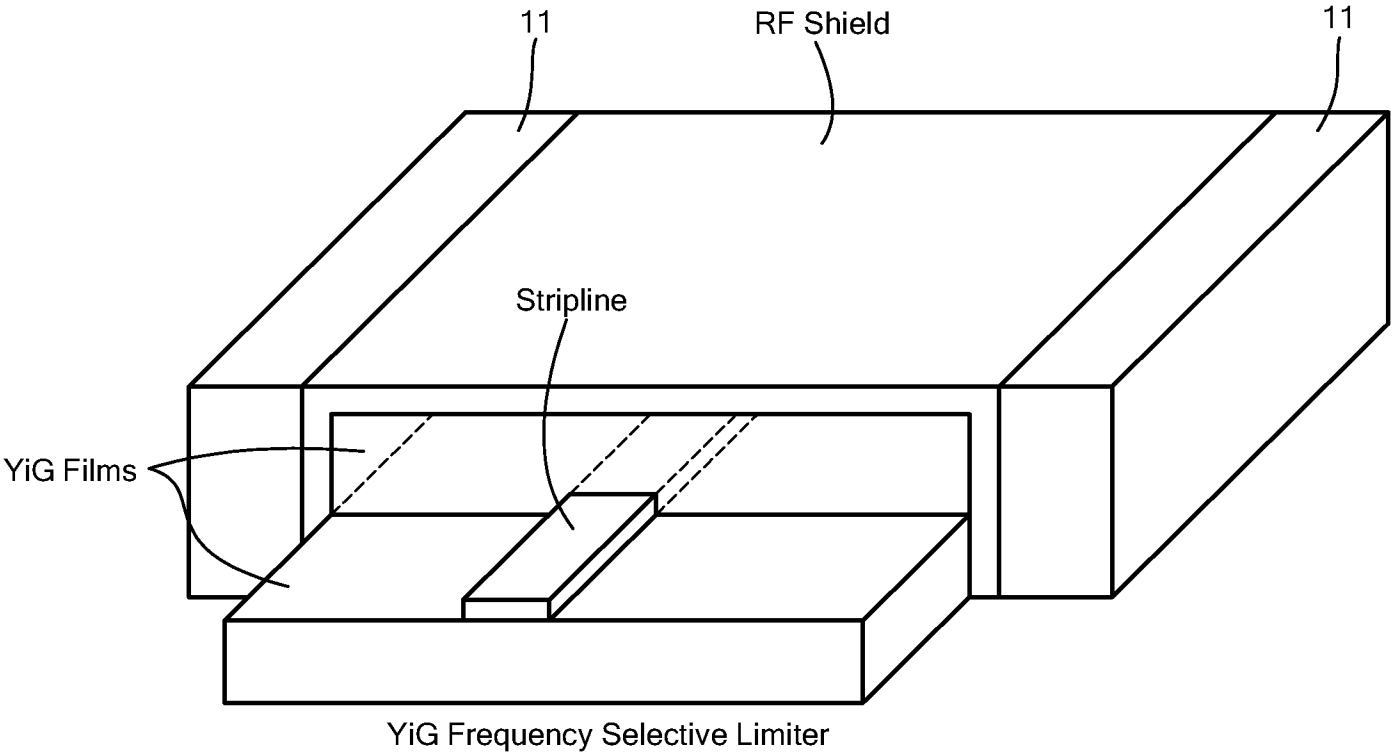
FIG.2 PRIOR ART
FIG. 2 shows an FSL according to the PRIOR ART.
Figure 3:
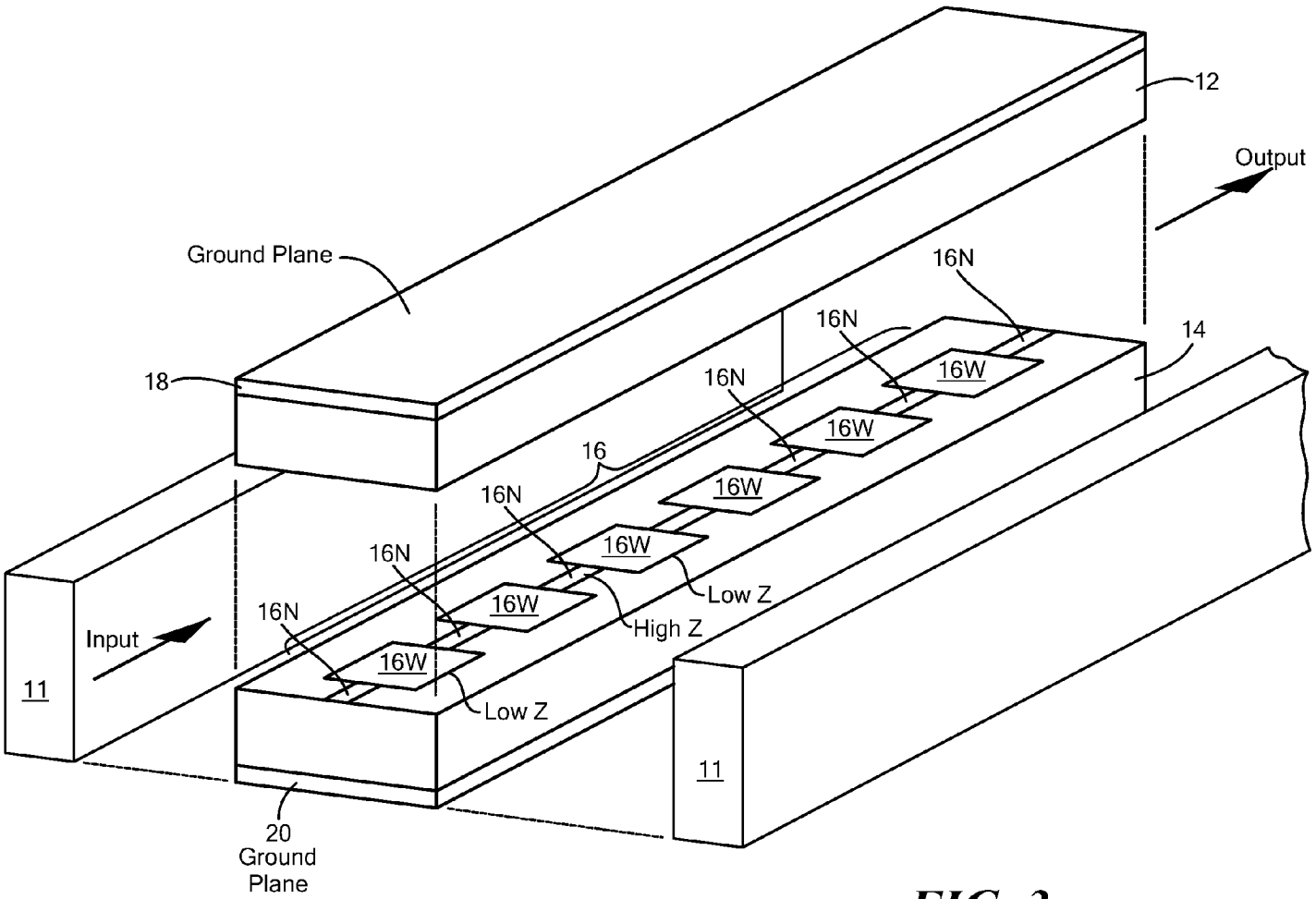
FIG. 3 is an exploded, isometric view of an FSL according to the disclosure.

Referring now to FIG. 3, a frequency selective limiter (FSL) 10 is shown. The limiter 10 is a slow wave structure comprising a stripline microwave transmission line having a series of different impedances $Z_{HIGH}$ and $Z_{LOW}$ from an INPUT of the limiter 10 to an OUTPUT of the limiter 10. More particularly, the limiter 10 includes a pair magnetic members, slabs 12, 14, here, for example, ferrimagnetic slabs, such as, for example, YIG slabs, 12, 14, having a strip conductor 16 sandwiched between the slab and ground plane conductors 18, 20 on the outer surface of the magnetic slabs 12, 14, as shown. The strip conductor 16 varies in width between a narrow width sections 16N and wider width sections 16W, as shown. Here, the slow wave structure 10 has in input impedance $Z_0$ of 50 ohms; the narrow section 16N providing impedances of here for example, 250 ohms and the wider sections 16W providing here for example, 10 ohms. The length of each section is less than the nominal operating wavelength of the electromagnetic energy pass into the FSL. The impedance of each section is established by the width of the strip conductor of such section. The size and spacing of the wide and narrow section 16N and 16W provide the slow wave structure with the input impedance $Z_0$ of 50 ohms. Thus, the impedances of the narrow sections and wider sections 16N and 16W here periodically change from an impedance greater than $Z_0$ to an impedance less than $Z_0$ as the electromagnetic energy propagates through the slow wave structure 10. It is noted that a conventional pair of bias magnets, 11 here permanent magnets, for example, are mounted to the sides of the structure. The permanent biasing magnets 11 may be mounted to the top and bottom of the structure. The strength of the magnetic field within the structure establishes the operating bandwidth of the limiter. An electro-magnet may be used in which case a wire, not shown, is wrapped around the entire structure to provide windings in a direction perpendicular to the stripline. DC current flows through the windings to provide a bias magnetic field. The bias is selected to establish the operating bandwidth of the limiter.

The slow wave structure 10 couples the magnetic energy of the input interfering signal that has higher power level (a power level above the predetermined FSL power threshold $P_{TH}$) of the slow wave structure 10 into the magnetic material of the magnetic slabs 12, 14. In other words, the slow wave structure 10 is used to magnetically couple a magnetic field, produced by electromagnetic energy propagating through the slow wave structure, into the magnetic slabs 12, 14.

Figure 4:
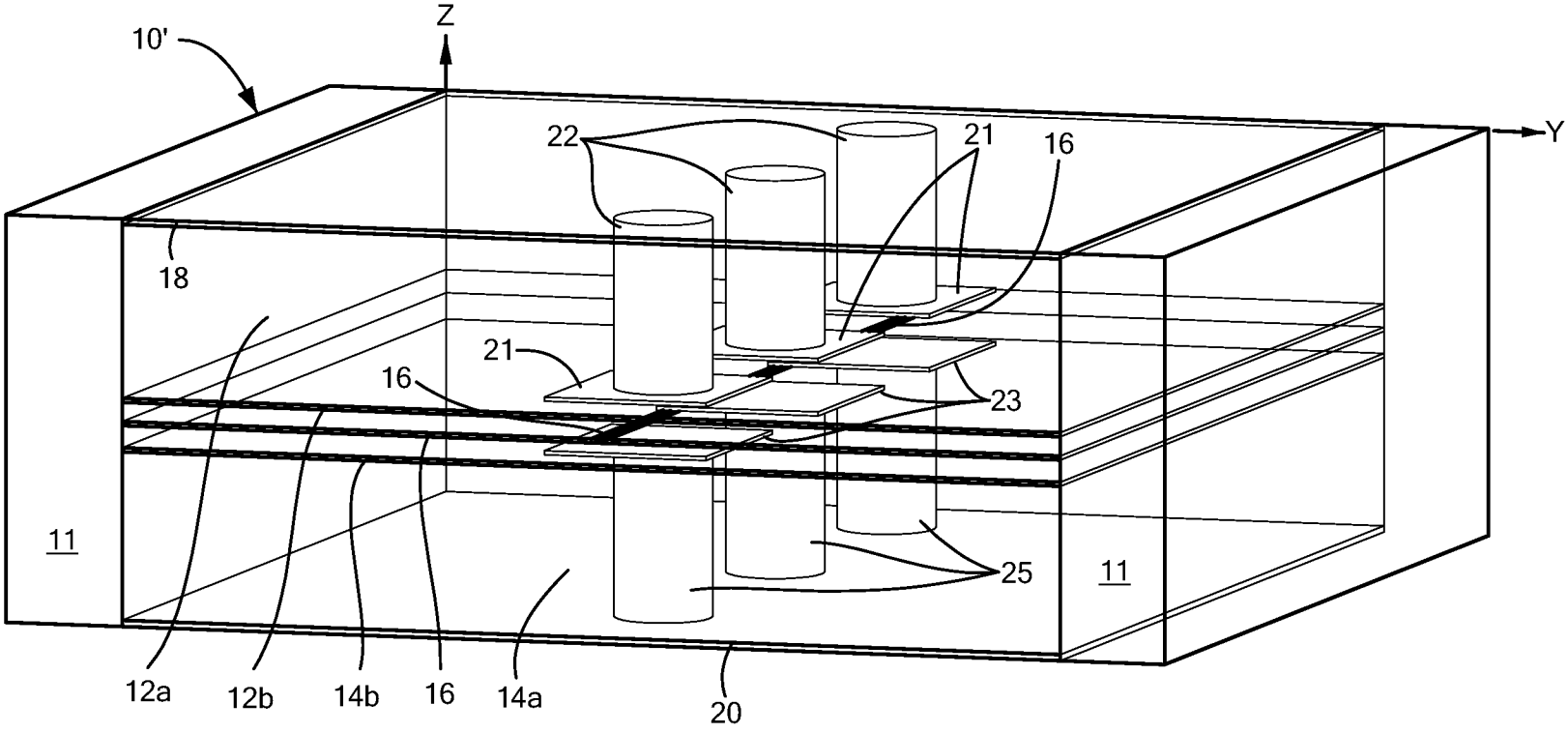
FIGS. 4 and 4A are diagrammatical isometric and cross sectional views, respectively, of an FSL according to another embodiment of the disclosure.
Figure 4A:
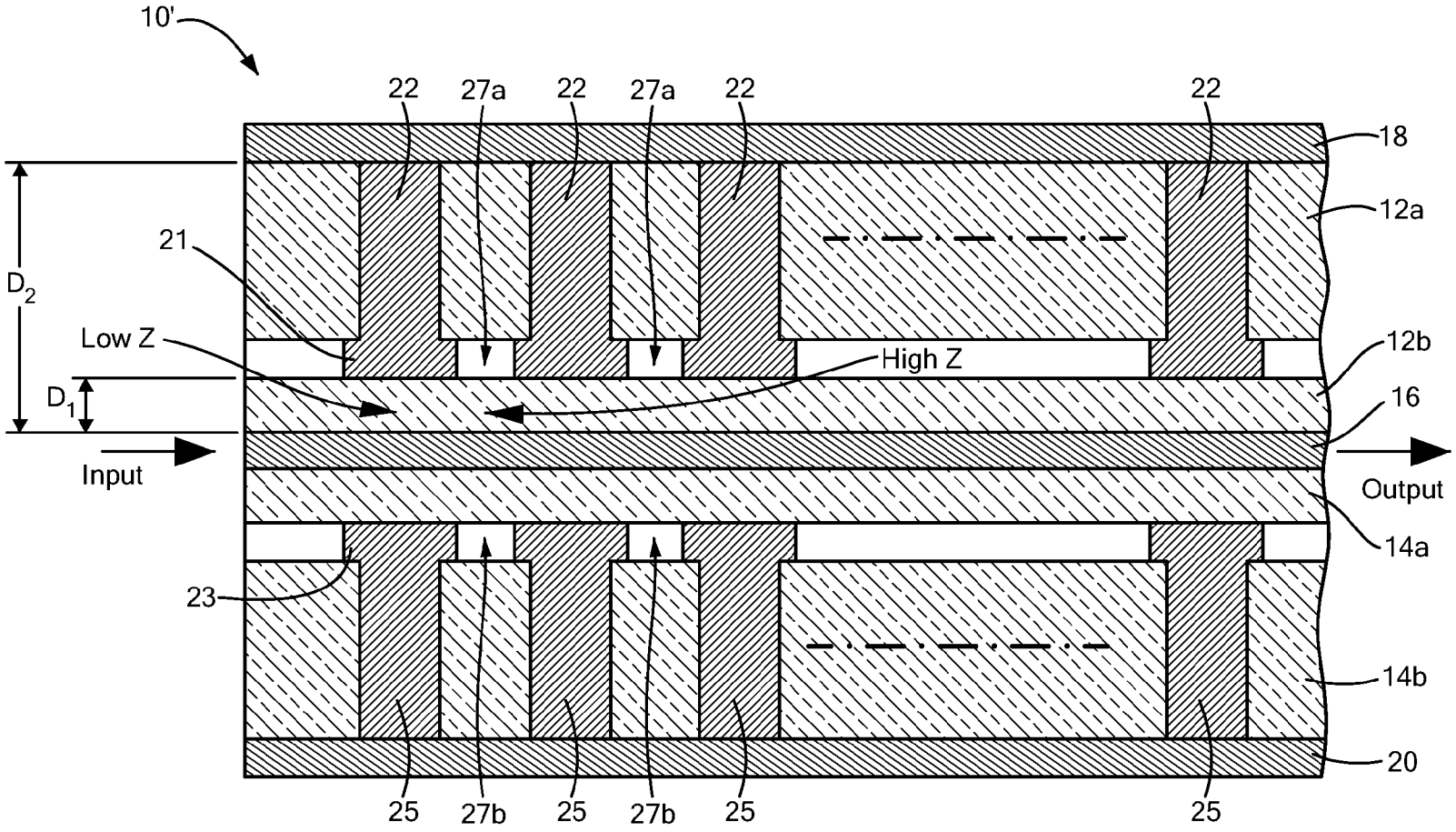
Figure 5A:
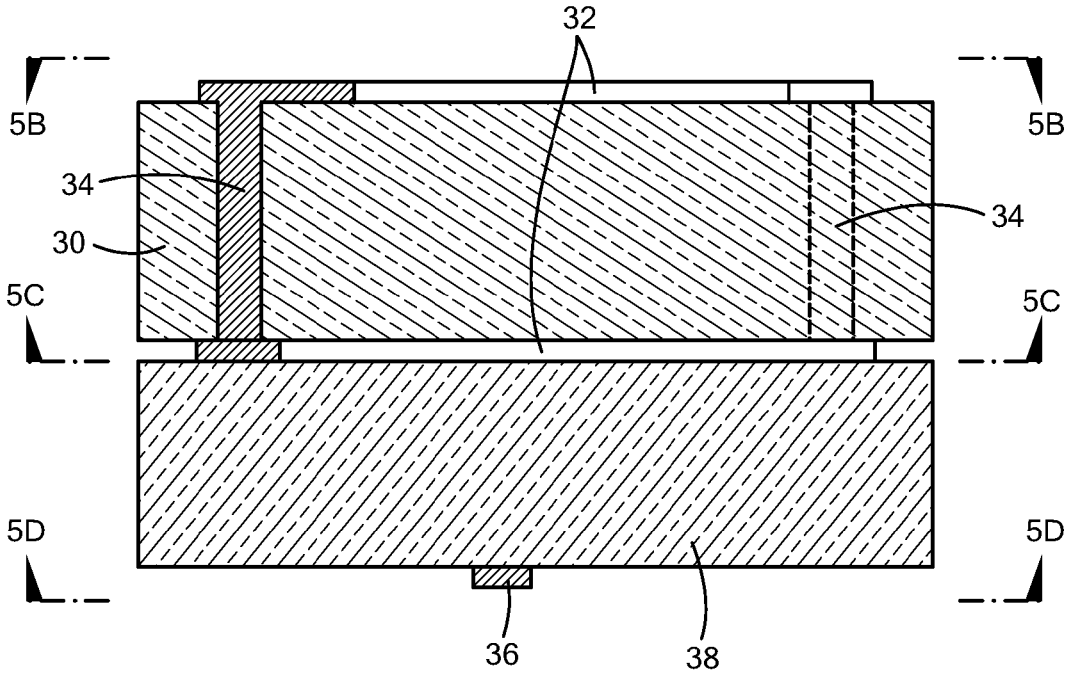
FIGS. 5A-5E, are different views of an FSL according to still another embodiment of the disclosure.
Figure 5B:
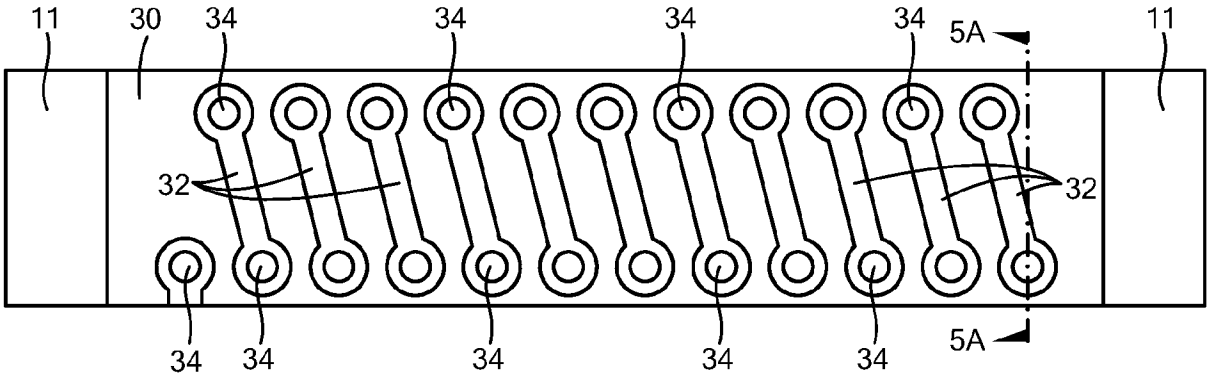
Figure 5C:
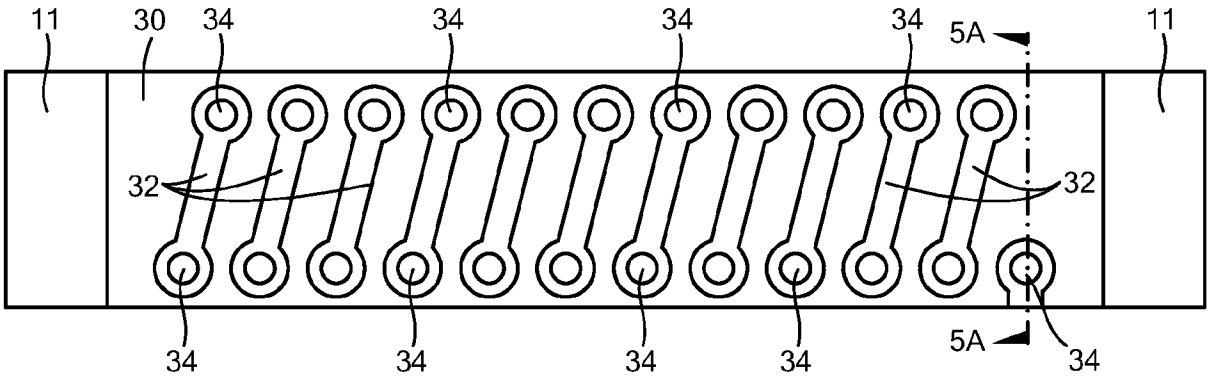
Figure 5D:
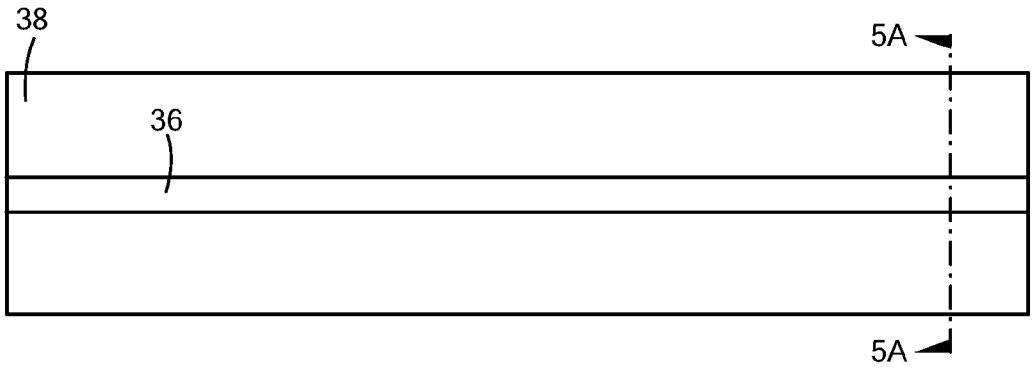
Figure 5E:
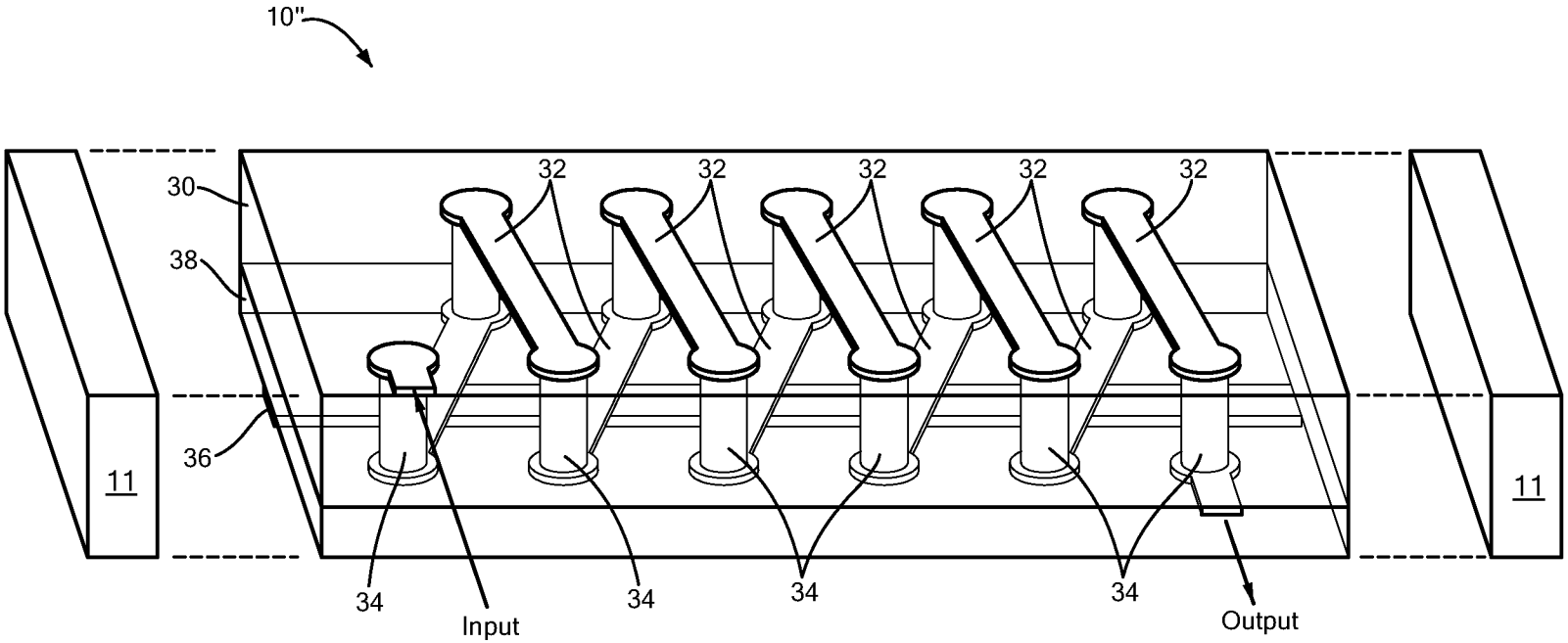

Referring now to FIGS. 4 and 4A, a slow wave structure FSL 10' is shown. The limiter 10' is a slow wave structure comprising a stripline microwave transmission line having a series of different impedances $Z_{HIGH}$ and $Z_{LOW}$ from an INPUT of the limiter 10' to an OUTPUT of the limiter 10'. More particularly, the limiter 10' includes a two pairs magnetic slabs 12*a*, 12*b*, and 14*a*, 14*b*, having a strip conductor 16 sandwiched between the slabs and ground plane conductors 18, 20 on the outer surface of the ferrimagnetic slabs 12*a* and 14*a*, as shown.

More particularly, a magnetic material, here for example, a ferrimagnetic slab 12*a*, has a ground plane conductor 18 on its outer surface and a series of conductive pads 21 laterally spaced by regions 27*a* on its inner surface, as shown. The conductive pads 12 are connected to the ground plane conductor 18 by conductive vias 22 passing through the slab 12*a* between the conductive pads 21 and the ground plane conductor 18, as shown.

Disposed between the upper surface of the strip conductor 16 and the conductive pads 21 is the ferromagnetic slab 12*b*, as shown.

Similarly, magnetic slab 14*a*, here, also, for example, a ferrimagnetic slab, has a ground plane conductor 20 on its outer surface and a series of conductive pads 23 laterally spaced by regions 27*b* on its inner surface, as shown. The conductive pads 23 are connected to the ground plane conductor 20 by conductive vias 25 passing through the slab 14*a* between the conductive pads 23 and the ground plane conductor 20, as shown.

Disposed between the bottom surface of the strip conductor 16 and the conductive pads 23 is the ferrimagnetic slab 14*b*, as shown.

It is noted that the distance D1 between the conductive pads 21, 23, (and hence, in effect, the electrically connected ground plane conductors 18, 20) respectively, and the strip conductor 16 is greater that the distance D2 between the strip conductor 16 and the ground plane conductors 18, 20 in the regions 27*a*, 27*b*. Thus, the impedance in the regions 27*a*, 27*b* $Z_{HIGH}$ is greater than the impedance $Z_{LOW}$ in the regions having the conductive pads 21, 23. Hence, here again the slow wave structure 10' has in input impedance $Z_0$ of 50 ohms; the regions 27*a*, 27*b* providing impedances of here for example, 250 ohms and the regions through the conductive pads 21, 23 providing here for example, 10 ohms. The size and distance D1, D2, provide the slow wave structure with the input impedance $Z_0$ of 50 ohms. Thus, the impedances of again periodically change from an impedance greater than $Z_0$ to an impedance less than $Z_0$ as the electromagnetic energy propagates through the slow wave structure 10'. The impedance of each section is established by the distance D1 and D2.

In this embodiment, width of the strip conductor 16 is set to a constant that minimizes small-signal insertion loss, and the impedance is set by varying the vertical distance of the ground planes 18, 20 using vias 22. While the complete FSL component is matched to 50Ω, the numerous low-impedance sections of the slow wave structure couple significantly higher magnetic energy into the ferrimagnetic slabs, locally reducing the $P_{TH}$ power threshold. This reduces the total effective power threshold, without also degrading the return loss or instantaneous bandwidth of the device. Referring now to FIGS. 5A-5E, another embodiment of an FSL is shown. Here, the FSL is a helical slow wave structure 10' having a magnetic body 30 made of a magnetic, here ferrimagnetic (e.g., YIG) substrate 30, as shown). The substrate 30 provides a magnetic core, for a helical conductor or coil 32. The helical conductor 32 is used to create a strong magnetic field within the ferrimagnetic material center, or core 30 due to reinforcement from adjacent turns in the coil 32. The coil 32 is implemented with conductive vias 34 to connect the top side of the coil 32 to the bottom side of the coil 32. Since the magnetic field outside of the coil is relatively small, it may not be beneficial to have additional magnetic, for example, YIG substrates (not shown), outside of the coil structure 32. In one application, the ground reference for the coil includes a metal trace 36 defined on the bottom side of a supporting dielectric slab 38. The dielectric slab 38 is bonded to the bottom of the magnetic body 30, whereby the supporting dielectric is attached to the ferrimagnetic core (or substrate) containing the coil 32. In this application, the dielectric material of dielectric slab 38 is a non-magnetic material such as FR-4 or a Rogers Corporation, Rogers, Conn. laminate material. In one application, the lowest critical fields are achieved when the static and RF induced magnetic fields are parallel.

It is noted that a pair of bias magnets 11, here permanent magnets, are included. The strength of the magnetic field within the structure establishes the operating bandwidth of the limiter. The coil structure is oriented perpendicular to the axial direction of the magnetic field produced by the magnets 11. For the case of biasing, it is noted that the permanent magnets 11 are disposed on either end of the coil rather than along the sides or the top and bottom.

Figure 6:
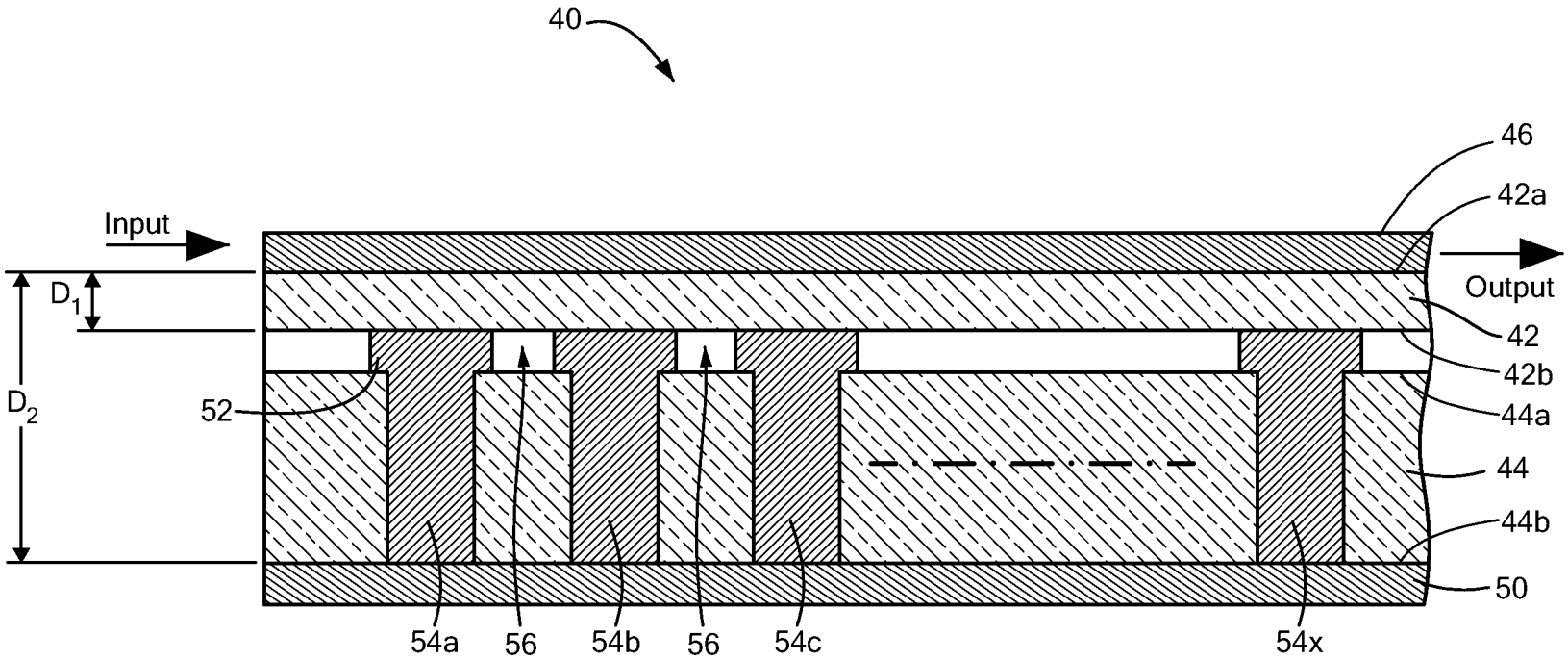
FIG. 6 is a cross-sectional view of an FSL having a microstrip transmission line according to another embodiment of the disclosure.

Now referring to FIG. 6, a frequency selective limiter 40 includes a magnetic material 42 disposed over a dielectric material 44 which in turn is disposed over a ground plane 50. Magnetic material 42 has first and second opposing surfaces 42*a*, 42*b* and dielectric material 44 also has first and second opposing surfaces 44*a*, 44*b*. In the illustrative embodiment of FIG. 6, the second surface 42*b* of magnetic material 42 disposed over the first surface 44*a* of dielectric material 44. A strip conductor 46 is disposed over the first surface 42*a* of magnetic material 42 such that ground plane 50, dielectric material 44 and magnetic material 42 form a microstrip transmission line structure.

In an embodiment, dielectric material 44 has a lower relative permittivity or relative dielectric constant, $\in_r$, than magnetic material 42. In some embodiments, magnetic material 42 may be provided as a ferromagnetic material, such as Yttrium iron garnet (YIG), and dielectric material 44 may be provided as a non-magnetic material, such as FR-4 laminate material or a Rogers Corporation, Rogers, Conn. laminate material (e.g., RO 4003 laminates). Other materials having similar mechanical and electrical properties, may of course, be used. For example and without limitation, magnetic material 42 may be provided as single crystal YIG, polycrystalline YIG, hexaferrite YIG or a variety of doped YIG materials. Further and without limitation, dielectric material 44 may include any material having a low relative permittivity (i.e., a relative dielectric constant of less than 4). In some embodiments, dielectric material 44 may be provided as alumnia or low-temperature co-fired ceramics (LTCC).

Conductive vias 54*a*-54*x* may be disposed through dielectric material 42 and at least electrically couple ground plane 50 to a first set of conductive pads 52 disposed between second surface 42*a* of magnetic material 42 and first surface 44*a* of dielectric material 44. Conductive vias 54*a*-54*x* may be spaced a predetermined distance from a neighboring or adjacent conductive via 54. In an embodiment, each conductive via 54*a*-54*x* is aligned with at least one conductive pad 52. In embodiments, conductive vias 54*a*-54*x* may be formed such that they are perpendicular to a plane in which lie ground plane 50 and strip conductor 46.

In an embodiment, a region 56 is formed between each conductive pad 52. Region 56 may include portions of dielectric material 44 that have reflowed into the gaps (i.e., regions 56) formed between each conductive pad 52 during fabrication. In some embodiments, region 56 includes an adhesive material that bonds dielectric material 44 to magnetic material 42. For example, the adhesive material may be provided as a lower melting temperature version of the same material provided in dielectric material 44. In other embodiments, region 56 may be provided as a different dielectric medium than the material provided in dielectric material 44.

In some embodiments, each of the conductive pads 52 may include an adhesive material disposed over at least one surface to adhere each conductive pad 52 to magnetic material 42. The adhesive material may be formed in a very thin layer over conductive pad 52, (e.g., thickness in the range of about 0.5 mil to about 2 mil). It should be appreciated that one of ordinary skill in the art will understand how to adhere dielectric layer 44 to the magnetic material layer, once a particular set of materials is selected.

Conductive vias 54*a*-54*x* may operate as a ground plane for low impedance portions within frequency selective limiter 40. For example and in the illustrative embodiment of FIG. 6, conductive vias 54*a*-54*x* form alternating sections of low impedance and high impedance microstrip transmission lines within frequency selective limiter 40. In an embodiment, the number of low impedance sections in frequency selective limiter 40 is equal to the number of high impedance sections.

In an embodiment, the characteristic impedance of a particular system establishes an impedance threshold between a low impedance section and a high impedance section. For example, a section having an impedance less than the characteristic impedance of the system can be a low impedance section and a section having an impedance greater than characteristic impedance of the system can be a high impedance section. In one embodiment, with a system having a characteristic impedance of 50 ohms, a low impedance section refers to a section having an impedance less than 50 ohms. In said embodiment, a high impedance section refers to a section having an impedance greater than 50 ohms. Of course other systems may have a characteristic impedance greater than or less than 50 ohms (e.g., a characteristic impedance of 40 ohms or 60 ohms may be desired). In one example embodiment, a low impedance section has an impedance less than 30 ohms and a high impedance section has an impedance greater than 75 ohms.

Thus, in an embodiment, frequency selective limiter 40 is a slow wave structure having a microstrip microwave transmission line and having a series of different impedances $Z_{HIGH}$ and $Z_{LOW}$ from an INPUT of frequency selective limiter 40 to an OUTPUT of frequency selective limiter 40.

In some embodiments, a pair of neighboring or adjacent sections (i.e., one low impedance section and one high impedance section) form a unit cell. The spacing between each unit cell may be the same or substantially similar. For example, each unit cell may be of equal length and width. The lengths and widths of the unit cells may be selected based upon a particular operating frequency or range of operating frequencies of frequency selective limiter 40. For example, in one embodiment, each unit cell may have a length of about 40 mil, which provides useful operation up to a frequency of about 5 GHz. In other embodiments, each unit cell may have a length of about 20 mil, which provides useful operation up to a frequency of about 10 GHz.

In some embodiments, a length (i.e., a dimension parallel to a length of strip conductor 46) of each conductive pad 52 may be equal to or about half the length of its corresponding unit cell. For example, in an embodiment with a unit cell having a length of about 20 mil, the respective conductive pad 54 would have a length of about 10 mil.

Each conductive pad 52 may be provided having a width (i.e., a dimension perpendicular to a length of strip conductor 46) that is wide enough to support a microstrip (or stripline) transmission line mode. For example, in some embodiments, each conductive pad 52 may be provided having a width that is at least three times a distance between the respective conductive pad 52 and strip conductor 46.

In some embodiments, a width (e.g., a dimension along a plane parallel to the plane in which first set of conductive pads 52 is disposed between second surface 42*a* of magnetic material 42 and first surface 44*a* of dielectric material 44) of each of the conductive vias 54*a*-54*x* may be provided such that it is less than a smallest dimension of the corresponding conductive pad 52 (i.e., length or width).

In one embodiment, each of the conductive pads 52 have the same or substantially similar dimensions and each of the conductive vias 54*a*-54*x* have the same or substantially similar dimensions, thus frequency selective limiter 40 may be provided as a generally symmetric structure.

In an embodiment, the impedance within frequency selective limiter 40 may be set or controlled by varying a vertical distance between a ground plane and strip conductor 46. For example, a distance, D1, between conductive pad 52 (i.e., acting as a ground plane to which conductive pad 52 is coupled to) to strip conductor 46 is less than a distance, D2, between ground plane 50 and strip conductor 46 in regions 56 where no conductive via 54 is disposed. Thus, an impedance in regions 56, $Z_{HIGH}$, is greater than the impedance, $Z_{LOW}$, in regions having conductive pads 52.

The alternating sections of low impedance microstrip lines and high impedance microstrip lines couple magnetic energy propagating through the slow wave structure and into magnetic material 42. In an embodiment, magnetic energy having a power level above or equal to a predetermined power level threshold of frequency selective limiter 40 is coupled into magnetic material 42. A combination of magnetic material 42 and dielectric material 44 in frequency selective limiter 40 increases the magnetic coupling of magnetic energy into magnetic material 42. For example, multiple low-impedance microstrip transmission lines couple significantly higher magnetic energy into magnetic material 42, thus reducing a total effective power threshold.

Figure 7:
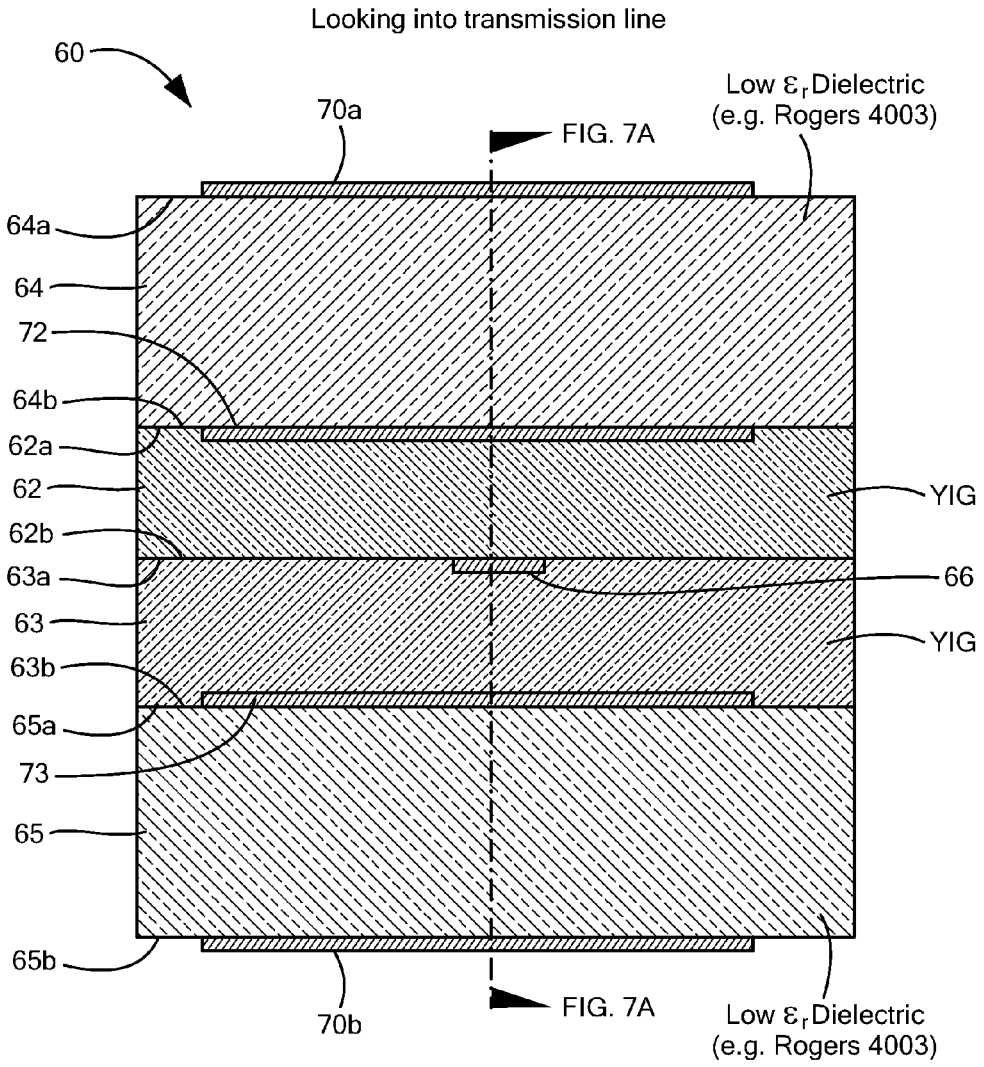
FIG. 7 is an end view of an FSL having a stripline transmission line according to another embodiment of the disclosure.
Figure 7A:
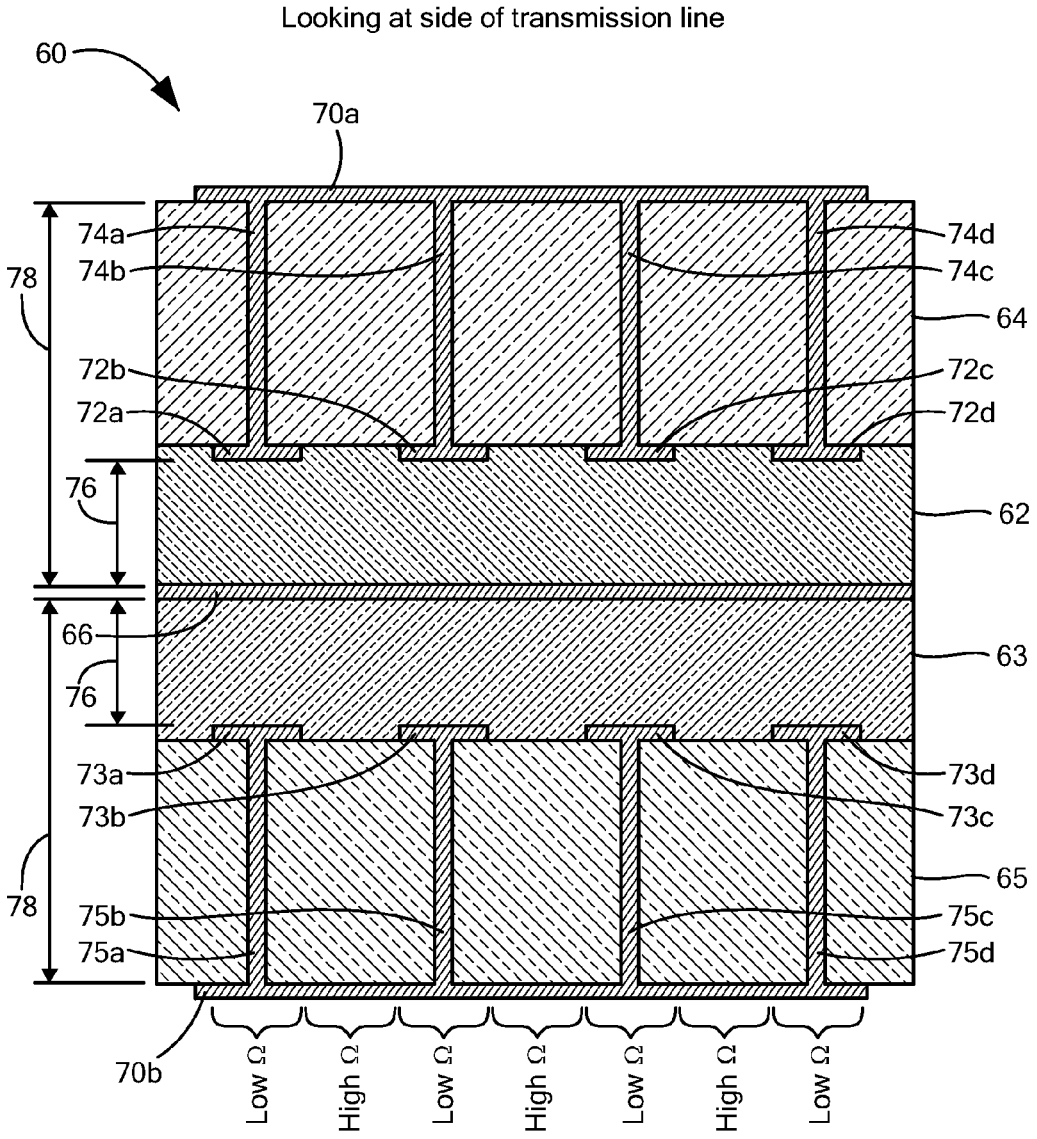
FIG. 7A is a cross-sectional view of an FSL taken across lines 7A-7A in FIG. 7.

Now referring to FIGS. 7 and 7A in which like elements are provided having like reference designations, a frequency selective limiter 60 includes a pair of magnetic materials 62, 63 disposed about a strip conductor 66 and a pair of dielectric materials 64, 65 with a first one of the dielectric materials 64, 65 disposed over a first one of the magnetic materials 62, 63 and a second one of the dielectric materials 64, 65 disposed over a second one of the magnetic materials 62, 63. In an embodiment, frequency selective limiter 60 is provided as a multi-layer frequency selective limiter structure having a stripline transmission line structure. For example, strip conductor 66 is disposed between surface 62*b* of the first magnetic material 62 and surface 63*a* of the second magnetic material 63. A second surface 64*b* of first dielectric material 64 is disposed over a first surface 62*a* of first magnetic material 62. A first ground plane 70*a* is disposed over a first surface 64*a* of second dielectric material 64. Further, a second surface 63*b* of second magnetic material 63 is disposed over a first surface 65*a* of second dielectric material 65. A second surface 65*b* of dielectric material 65 is disposed over a second ground plane 70*b*.

In an embodiment, frequency selective limiter 60 includes two sets of conducting pads 72, 73. Each set disposed may be disposed between magnetic material 62, 63 and dielectric material 64, 65. For example, and as illustrated in FIG. 7, a first set of conductive pads 72 are disposed between second surface 64*b* of dielectric material 64 and first surface 62*a* of magnetic material 62. Further, a second set of conductive pads 73 are disposed between second surface 63*b* of magnetic material 63 and first surface 65*a* of dielectric material 65.

As may be most clearly seen in FIG. 7A, two sets of conductive vias 74*a*-74*d*, 75*a*-75*d* are disposed through respective ones of dielectric material layers 64, 65. Respective ones of conductive vias 74*a*-74*d*, 75*a*-75*d* electrically couple respective ones of pads 72*a*-72*d* and 73*a*-73*d* to respective ones of ground planes 70*a*, 70*b*. To vary an impedance presented to an RF signal propagating along the stripline transmission line formed by strip conductor 66 and the ground planes, through frequency selective limiter 60, a vertical distance between ground planes 70*a*, 70*b* and strip conductor 66 may be controlled.

In the illustrative embodiment of FIG. 7A, conductive vias 74*a*-74*d*, 74*a*-*d* disposed through respective ones of the dielectric materials 64, 65 electrically couple respective ones of ground planes 70*a*, 70*b* to respective ones of conductive pads 72*a*-72*d*, 73*a*-73*d* to thereby form alternating sections of low impedance stripline sections 76 and high impedance stripline sections 78 within frequency selective limiter 60. Thus, in an embodiment, frequency selective limiter 60 is a slow wave structure having a stripline microwave transmission line having a series of different impedances $Z_{HIGH}$ 78 and $Z_{LOW}$ 76 from an input of frequency selective limiter 60 to an OUTPUT of frequency selective limiter 60.

The alternating sections of low impedance striplines 76 and high impedance striplines 78 couple magnetic energy propagating through the slow wave structure and into the pair of magnetic materials 62, 63.

In an embodiment, using alternating (i.e., periodic) segments having very low characteristic impedance (e.g., low impedance striplines 76 having an impedance less than a system characteristic impedance), a magnetic interaction of signals with magnetic materials 62, 63 is increased. The combination of magnetic material 62, 63 and dielectric material 64, 65 may couple higher magnetic field into magnetic material 62, 63 in low impedance stripline sections 76. Thus, an effective power threshold of when nonlinearity occurs for frequency selective limiter 60 is reduced. In an embodiment, by lowering the power level required to cause nonlinear behavior, frequency selective limiter 60 provides protection for even lower levels of input power. For example, in one embodiment with a power threshold of about 10 dBm, an interfering signal of about 5 dBm may still cause problems. However, frequency selective limiter 60 with a reduced power threshold level of about 0 dBm would provide protection against the same 5 dBm interfering signal.

In an embodiment, a width of the strip conductor 66 is set to a constant that reduces (and ideally minimizes) small-signal insertion loss, and the impedance is set by varying the vertical distance of the ground planes 70*a*, 70*b* and hence the length of the conductive vias 74*a*-74*d*, 75*a*-75*d*. For example, in low impedance striplines 76, first and second ground planes 70*a*, 70*b* are closer to strip conductor 66 (providing higher capacitance thus lower impedance) and in high impedance striplines 78, first and second ground planes 70*a*, 70*b* are farther away from center strip conductor 66 and have an effective dielectric constant (a function of the combination of magnetic material 62, 63 and dielectric material 64, 65) that is lower thus providing a higher impedance.

Impedances at input and output ports of the frequency selective limiter 60 may be matched to a desired characteristic impedance (e.g. a characteristic impedance of a system in which the FSL is included such as a 50Ω characteristic impedance). At the same time, however, the numerous low-impedance sections of the slow wave structure couple significantly higher magnetic energy into magnetic material 62, 63, locally reducing the power threshold (PTH). For example, when a section of frequency selective limiter 60 has a low impedance, a magnetic field of a radio frequency (RF) signal is higher than a section of frequency selective limiter 60 having a high impedance. Thus, the FSL structures described herein are capable of both reducing the total effective power threshold, without also degrading the return loss or instantaneous bandwidth of the device.

In one example embodiment, frequency selective limiter 60 is formed having two layers of 100 μm thick polycrystalline YIG as magnetic material 62, 63 and two layers of 60 mil thick Rogers 4003 as dielectric material 64, 65. First ground plane 70*a* is disposed over first surface 64*a* of first dielectric material 64. Second surface 64*b* of first dielectric material 64 is disposed over first surface 62*a* of first magnetic material 62. Strip conductor 66 is disposed between second surface 62*a* and first surface 63*a* of second magnetic material 63. Second surface 63*b* of second magnetic material 63 is disposed over first surface 65*a* of second dielectric material 65. Second dielectric material 65 is disposed over second ground plane 70*b*.

In such an embodiment, a twenty (20) ohm section of transmission line is provided from a strip conductor having a width of about 175 μm (i.e., $Z_{LOW}$ 76) when the YIG ground planes (i.e., conducting pads 72, 73) are used, while a 50 μm wide stripline conductor (i.e., $Z_{HIGH}$ 78) achieves a 120 ohm impedance when the ground planes 70*a*, 70*b* on the outside portions of dielectric materials 64, 65 (e.g., Rogers material) is used.

In an embodiment, stripline segment lengths 76, 78 are formed to be electrically small, such as less than a wavelength (λ, where λ is the nominal operating wavelength of frequency selective limiter 60). For example, in one embodiment, stripline segment lengths 76, 78 are formed to be less than 1/10 of a wavelength (<(1/10)(λ) at a maximum frequency of operation), which results in a 49 ohm characteristic impedance and a slow wave factor of 1.43. Thus, an increased magnetic field intensity produced by the low impedance segments 76 decreases the frequency selective limiter's 60 power threshold by activating spin waves in dielectric material 64, 65 (i.e., YIG material) at an earlier onset that if a 50 ohm line had been used.

In some embodiments, conductive vias 74, 75 and ground planes 70*a*, 70*b* may be formed by fabricating on or within dielectric material 64, 65, thus no micromachining or etching of dielectric material 64, 65 is required.

A number of embodiments of the disclosure have been described. Nevertheless, it will be understood that various modifications may be made without departing from the spirit and scope of the disclosure. For example, the high and low impedance lines may be by varied using both the ground plane height and the width of the center conductor line. In another embodiment, in the helical slow wave embodiment, the ground plane reference could be manifested by placing the coil inside a metal container shield with air or dielectric gaps between the coil and the metal shield.

Accordingly, other embodiments are within the scope of the following claims.

What is claimed is:

1. A frequency selective limiter comprising:

a first layer of a dielectric material having first and second opposing surfaces;

a first layer of magnetic material having first and second opposing surfaces, wherein the second surface of the first layer of the dielectric material is disposed on the first surface of the first magnetic material, and wherein the dielectric material has a lower relative permittivity than the magnetic material;

a second layer of a dielectric material having first and second opposing surfaces;

a second layer of magnetic material having first and second opposing surfaces, wherein the first surface of the second layer of the dielectric material is disposed on the second surface of the second magnetic material;

a strip conductor disposed between the first and second layer of magnetic material;

first and second ground planes, wherein the first ground plane is disposed on the first surface of the first layer of dielectric material and the second ground plane is disposed on the second surface of the second layer of dielectric material;

a first set of conducting pads disposed between the first layer of the dielectric material and the first layer of magnetic material and a second set of conducting pads disposed between the second layer of the dielectric material and the second layer of magnetic material; and a first set of vias disposed within the first layer of the dielectric material and a second set of vias disposed within the second layer of the dielectric material;

wherein the combination of the first and second layers of dielectric material and the first and second layers of magnetic material comprise a slow wave structure having an input impedance $Z_0$ and wherein the impedances periodically change from an impedance greater than $Z_0$ to an impedance less than $Z_0$ as an electromagnetic energy propagates through the slow wave structure.

2. The frequency selective limiter of claim 1, wherein the first set of vias couple the first ground plane to the first set of conducting pads and the second set of vias couple the second ground plane to the second set of conducting pads to form alternating sections of low impedance stripline sections and high impedance stripline sections within the slow wave structure.

3. The frequency selective limiter of claim 2, wherein the alternating sections of low impedance stripline sections and high impedance stripline sections couple a magnetic energy propagating through the slow wave structure and into the first and second magnetic layers, wherein the magnetic energy has a power level above a predetermined power threshold.

4. The frequency selective limiter of claim 1, wherein the frequency selective limiter comprises a transmission line having the input impedance Zo and wherein the transmission line includes a first transmission line section disposed between a pair of second transmission line sections, wherein the first transmission line section has an impedance $Z_H$ higher than $Z_0$ and the pair of second transmission line sections have an impedance $Z_L$ lower than $Z_0$, and wherein the first transmission line section includes portions of the strip conductor and portions of the first or the second layer of magnetic material and the pair of second transmission line sections includes portions of the strip conductor, portions of the first or the second layer of magnetic material and portions of the first or the second layers of dielectric material.

5. The frequency selective limiter of claim 4, wherein the first transmission line section and the pair of second transmission lines sections each have a length shorter than a nominal operating wavelength of the electromagnetic energy propagating through the slow wave structure.

6. A frequency selective limiter comprising:

a magnetic material to magnetically couple a magnetic field, produced by electromagnetic energy propagating through a slow wave structure, into the magnetic material;

a dielectric layer disposed on the magnetic material, wherein the dielectric layer has a lower relative permittivity than the magnetic material;

a ground plane disposed on a first surface of the dielectric layer;

a set of conducting pads disposed between the dielectric layer and the magnetic material;

a set of vias disposed within the dielectric layer, wherein the set of vias couple the ground plane to the set of conducting pads to form alternating sections of low impedance microstrip sections and high impedance microstrip sections within the slow wave structure: and the slow wave structure having an input impedance $Z_0$ and wherein the alternating sections of the low and high impedance sections periodically change from an impedance greater than $Z_0$ to an impedance less than $Z_0$ as the electromagnetic energy propagates through the slow wave structure.

7. The slow wave structure of claim 6, wherein the alternating sections of low impedance microstrip sections and high impedance microstrip sections couple the electromagnetic energy propagating through the slow wave structure and into the magnetic material, wherein the electromagnetic energy has a power level above a predetermined power threshold.

8. A frequency selective limiter comprising:

a first layer of a dielectric material and a second layer of a dielectric material, each having first and second opposing surfaces;

a first layer of a magnetic material and a second layer of a magnetic material; each having first and second opposing surfaces, wherein the second surface of the first layer of the dielectric material is disposed on the first surface of the first magnetic material and the first surface of the second layer of the dielectric material is disposed on the second surface of the second magnetic material, wherein the dielectric material has a lower relative permittivity than the magnetic material;

a strip conductor disposed between the first and second layer of magnetic material; and a slow wave structure comprising a transmission line having an input impedance $Z_0$ and wherein the transmission line includes a first transmission line section and a pair of second transmission line sections, wherein the first transmission line section has an impedance $Z_H$ higher than $Z_0$ and the pair of second transmission line sections have an impedance lower than $Z_0$;

wherein the first transmission line section includes portions of the strip conductor and portions of the first or the second layer of magnetic material and the pair of second transmission line sections includes portions of the strip conductor, portions of the first or the second layer of magnetic material and portions of the first or the second layers of dielectric material.

9. The frequency selective limiter of claim 8, wherein the impedance higher than Zo to the impedance less than Zo periodically changes through the slow wave structure.

10. The frequency selective limiter of claim 8, further comprising first and second ground planes, wherein the first ground plane is disposed on the first surface of the first layer of dielectric material and the second ground plane is disposed on the second surface of the second layer of dielectric material.

11. The frequency selective limiter of claim 10, further comprising a first set of conducting pads disposed between the first layer of the dielectric material and the first layer of magnetic material and a second set of conducting pads disposed between the second layer of the dielectric material and the second layer of magnetic material.

12. The frequency selective limiter of claim 11, further comprising a first set of vias disposed within the first layer of dielectric material and a second set of vias disposed within the second layer of dielectric material, wherein the first set of vias couple the first ground plane to the first set of conducting pads and the second set of vias couple the second ground plane to the second set of conducting pads to form alternating sections of low impedance stripline sections and high impedance stripline sections within the slow wave structure.

13. The frequency selective limiter of claim 8, wherein the first transmission line section and the pair of second transmission lines sections each have a length shorter than a nominal operating wavelength of an electromagnetic energy propagating through the slow wave structure.

* * * * *